US008721033B2

(12) United States Patent
Mongeon et al.

(10) Patent No.: US 8,721,033 B2
(45) Date of Patent: May 13, 2014

(54) METHOD FOR ANALYZING IMAGE DATA CORRESPONDING TO A TEST PATTERN EFFECTIVE FOR FINE REGISTRATION OF INKJET PRINTHEADS IN AN INKJET PRINTER

(71) Applicant: Xerox Corporation, Norwalk, CT (US)

(72) Inventors: Michael C. Mongeon, Walworth, NY (US); Howard A. Mizes, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/021,408

(22) Filed: Sep. 9, 2013

(65) Prior Publication Data

US 2014/0009527 A1 Jan. 9, 2014

Related U.S. Application Data

(62) Division of application No. 12/754,735, filed on Apr. 6, 2010.

(51) Int. Cl.
*B41J 29/393* (2006.01)

(52) U.S. Cl.
USPC ..... 347/19

(58) Field of Classification Search
USPC ..... 347/19
See application file for complete search history.

(56) References Cited

U.S. PATENT DOCUMENTS

| | | | |
|---|---|---|---|
| 4,401,024 | A | 8/1983 | Frentress |
| 4,675,696 | A | 6/1987 | Suzuki |
| RE32,967 | E | 6/1989 | St. John et al. |
| 4,887,530 | A | 12/1989 | Sainio |
| 5,325,159 | A | 6/1994 | Day |
| 5,343,231 | A | 8/1994 | Suzuki |
| 5,451,990 | A | 9/1995 | Sorenson et al. |
| 5,539,498 | A | 7/1996 | DeCock et al. |
| 5,600,350 | A | 2/1997 | Cobbs et al. |
| 5,796,414 | A | 8/1998 | Sievert et al. |
| 5,887,236 | A | 3/1999 | Hirao et al. |
| 5,992,973 | A | 11/1999 | Wen |
| 6,049,680 | A | 4/2000 | Goris et al. |

(Continued)

OTHER PUBLICATIONS

Office Action for U.S. Appl. No. 12/754,730, mailed Jun. 6, 2012, United States Patent and Trademark Office (9 pages).

(Continued)

*Primary Examiner* — Julian Huffman
*Assistant Examiner* — Sharon A Polk
(74) *Attorney, Agent, or Firm* — Maginot, Moore & Beck, LLP

(57) ABSTRACT

A method analyzes image data of a test pattern printed on an image receiving member by a printer. The method includes identifying a process direction position for each row of dashes in a test pattern printed on an image receiving member, identifying a center of each dash in a cross-process direction, identifying an inkjet ejector that formed each dash in the row of dashes. These data are used to identify a process direction position for each printhead, a cross-process displacement for each column of printheads, and a stitch displacement in the cross-process direction between neighboring printheads in a print bar unit that print a same color of ink. An actuator can be operated with reference to the identified process direction positions, cross-process displacements, and the identified stitch displacements to move at least some of the printheads in the printer.

11 Claims, 8 Drawing Sheets

(56) References Cited

U.S. PATENT DOCUMENTS

| | | | | |
|---|---|---|---|---|
| 6,072,587 | A | 6/2000 | Hicks | |
| 6,076,915 | A | 6/2000 | Gast et al. | |
| 6,089,693 | A | 7/2000 | Drake et al. | |
| 6,109,722 | A | 8/2000 | Underwood et al. | |
| 6,196,652 | B1 | 3/2001 | Subirada et al. | |
| 6,266,437 | B1 | 7/2001 | Eichel et al. | |
| 6,275,600 | B1 | 8/2001 | Banker et al. | |
| 6,300,968 | B1 | 10/2001 | Kerxhalli et al. | |
| 6,334,720 | B1 | 1/2002 | Kato et al. | |
| 6,352,331 | B1 | 3/2002 | Armijo et al. | |
| 6,377,758 | B1 | 4/2002 | OuYang et al. | |
| 6,467,867 | B1 | 10/2002 | Worthington et al. | |
| 6,494,558 | B1 | 12/2002 | Doval et al. | |
| 6,554,390 | B2 | 4/2003 | Arquilevich et al. | |
| 6,637,853 | B1 | 10/2003 | Ahne et al. | |
| 6,639,669 | B2 | 10/2003 | Hubble, III et al. | |
| 6,655,771 | B2 | 12/2003 | Matsumoto et al. | |
| 6,847,465 | B1 | 1/2005 | Wetchler et al. | |
| 6,883,892 | B2 | 4/2005 | Sievert et al. | |
| 6,942,313 | B2 | 9/2005 | Kanda | |
| 6,993,275 | B2 | 1/2006 | Mitsuya et al. | |
| 7,073,883 | B2 | 7/2006 | Billow | |
| 7,090,324 | B2 | 8/2006 | Mizes | |
| 7,118,188 | B2 | 10/2006 | Vilanova et al. | |
| 7,216,948 | B2 | 5/2007 | Matsuzaki et al. | |
| 7,254,254 | B2 | 8/2007 | Ueda et al. | |
| 7,309,118 | B2 | 12/2007 | Mizes et al. | |
| 7,380,897 | B2 | 6/2008 | Anderson et al. | |
| 7,390,073 | B2 | 6/2008 | Bailey et al. | |
| 7,391,525 | B2 | 6/2008 | Chapman et al. | |
| 7,478,894 | B2 | 1/2009 | Kim et al. | |
| 7,515,305 | B2 | 4/2009 | Mizes | |
| 7,543,911 | B2 * | 6/2009 | Mizes et al. | 347/41 |
| 7,549,721 | B2 | 6/2009 | Nakano et al. | |
| 7,552,986 | B2 | 6/2009 | Mizes et al. | |
| 7,584,699 | B2 | 9/2009 | Ford | |
| 7,607,752 | B2 | 10/2009 | Childers et al. | |
| 7,630,519 | B2 | 12/2009 | Nagarajan | |
| 7,630,653 | B2 | 12/2009 | Bonino | |
| 7,637,586 | B2 | 12/2009 | Yun | |
| 7,647,018 | B2 | 1/2010 | Moore et al. | |
| 7,686,298 | B2 | 3/2010 | Fioravanti et al. | |
| 2002/0131800 | A1 | 9/2002 | Jacob et al. | |
| 2002/0135629 | A1 | 9/2002 | Sarmast et al. | |
| 2003/0082360 | A1 | 5/2003 | O'Donnell et al. | |
| 2003/0231350 | A1 | 12/2003 | Yamagishi | |
| 2004/0160468 | A1 | 8/2004 | Kim et al. | |
| 2005/0099447 | A1 | 5/2005 | Hsu et al. | |
| 2006/0072939 | A1 | 4/2006 | Kremer et al. | |
| 2006/0109329 | A1 | 5/2006 | Holtman et al. | |
| 2006/0109330 | A1 | 5/2006 | Holtman | |
| 2006/0114302 | A1 | 6/2006 | Holtman | |
| 2008/0062219 | A1 | 3/2008 | Mizes et al. | |
| 2008/0124158 | A1 | 5/2008 | Folkins | |
| 2009/0265950 | A1 | 10/2009 | Mizes et al. | |
| 2009/0293750 | A1 | 12/2009 | Haenni et al. | |
| 2009/0322849 | A1 | 12/2009 | Calamita et al. | |
| 2010/0013882 | A1 | 1/2010 | Mizes et al. | |
| 2012/0056928 | A1 | 3/2012 | Powers et al. | |
| 2012/0155894 | A1 | 6/2012 | Kim et al. | |
| 2012/0206531 | A1 * | 8/2012 | Mizes et al. | 347/19 |

OTHER PUBLICATIONS

Amendment in Response to Office Action for U.S. Appl. No. 12/754,730, submitted Sep. 5, 2012 (14 pages).
Final Office Action for U.S. Appl. No. 12/754,730, mailed Nov. 14, 2012, United States Patent and Trademark Office (17 pages).
Amendment in Response to Final Office Action for U.S. Appl. No. 12/754,730, submitted Feb. 13, 2013 (13 pages).
Office Action after Final Office Action for U.S. Appl. No. 12/754,730, mailed Apr. 16, 2013, United States Patent and Trademark Office (12 pages).
Amendment in Response to Office Action after Final Office Action for U.S. Appl. No. 12/754,730, submitted Jul. 12, 2013 (14 pages).
Office Action for U.S. Appl. No. 12/754,867, mailed Apr. 9, 2012, United States Patent and Trademark Office (7 pages).
Amendment in Response to Office Action for U.S. Appl. No. 12/754,867, submitted May 1, 2012 (6 pages).
Second Office Action for U.S. Appl. No. 12/754,867, mailed Jul. 10, 2012, United States Patent and Trademark Office (7 pages).
Amendment in Response to Second Office Action for U.S. Appl. No. 12/754,867, submitted Sep. 10, 2012 (10 pages).

* cited by examiner

METHOD FOR ANALYZING IMAGE DATA CORRESPONDING TO A TEST PATTERN EFFECTIVE FOR FINE REGISTRATION OF INKJET PRINTHEADS IN AN INKJET PRINTER

TECHNICAL FIELD

This application claims priority to and is a divisional application of co-pending U.S. patent application Ser. No. 12/754,735, which is entitled "Test Pattern Effective For Fine Registration Of Inkjet Printheads And Method Of Analysis Of Image Data Corresponding To The Test Pattern In An Inkjet Printer" and was filed on Apr. 6, 2010.

TECHNICAL FIELD

This disclosure relates generally to identification of printhead orientation in an inkjet printer having one or more printheads, and, more particularly, to analysis of image data to identify the printhead orientation.

BACKGROUND

Ink jet printers have printheads that operate a plurality of inkjets that eject liquid ink onto an image receiving member. The ink may be stored in reservoirs located within cartridges installed in the printer. Such ink may be aqueous ink or an ink emulsion. Other inkjet printers receive ink in a solid form and then melt the solid ink to generate liquid ink for ejection onto the imaging member. In these solid ink printers, the solid ink may be in the form of pellets, ink sticks, granules or other shapes. The solid ink pellets or ink sticks are typically placed in an ink loader and delivered through a feed chute or channel to a melting device that melts the ink. The melted ink is then collected in a reservoir and supplied to one or more printheads through a conduit or the like. In other inkjet printers, ink may be supplied in a gel form. The gel is also heated to a predetermined temperature to alter the viscosity of the ink so the ink is suitable for ejection by a printhead.

A typical inkjet printer uses one or more printheads. Each printhead typically contains an array of individual nozzles for ejecting drops of ink across an open gap to an image receiving member to form an image. The image receiving member may be a continuous web of recording media, a series of media sheets, or the image receiving member may be a rotating surface, such as a print drum or endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an orifice from an ink filled conduit in response to an electrical voltage signal, sometimes called a firing signal. The magnitude, or voltage level, of the signals affects the amount of ink ejected in each drop. The firing signal is generated by a printhead controller in accordance with image data. An inkjet printer forms a printed image in accordance with the image data by printing a pattern of individual ink drops at particular locations on the image receiving member. The locations where the ink drops landed are sometimes called "ink drop locations," "ink drop positions," or "pixels." Thus, a printing operation can be viewed as the placement of ink drops on an image receiving member in accordance with image data.

In order for the printed images to correspond closely to the image data, both in terms of fidelity to the image objects and the colors represented by the image data, the printheads must be registered with reference to the imaging surface and with the other printheads in the printer. Registration of printheads is a process in which the printheads are operated to eject ink in a known pattern and then the printed image of the ejected ink is analyzed to determine the orientation of the printhead with reference to the imaging surface and with reference to the other printheads in the printer. Operating the printheads in a printer to eject ink in correspondence with image data presumes that the printheads are level with a width across the image receiving member and that all of the inkjet ejectors in the printhead are operational. The presumptions regarding the orientations of the printheads, however, cannot be assumed, but must be verified. Additionally, if the conditions for proper operation of the printheads cannot be verified, the analysis of the printed image should generate data that can be used either to adjust the printheads so they better conform to the presumed conditions for printing or to compensate for the deviations of the printheads from the presumed conditions.

Analysis of printed images is performed with reference to two directions. "Process direction" refers to the direction in which the image receiving member is moving as the imaging surface passes the printhead to receive the ejected ink and "cross-process direction" refers to the direction across the width of the image receiving member. In order to analyze a printed image, a test pattern needs to be generated so determinations can be made as to whether the inkjets operated to eject ink did, in fact, eject ink and whether the ejected ink landed where the ink would have landed if the printhead was oriented correctly with reference to the image receiving member and the other printheads in the printer. In some printing systems, an image of a printed image is generated by printing the printed image onto media or by transferring the printed image onto media, ejecting the media from the system, and then scanning the image with a flatbed scanner or other known offline imaging device. This method of generating a picture of the printed image suffers from the inability to analysis the printed image in situ and from the inaccuracies imposed by the external scanner. In some printers, a scanner is integrated into the printer and positioned at a location in the printer that enables an image of an ink image to be generated while the image is on media within the printer or while the ink image is on the rotating image member. These integrated scanners typically include one or more illumination sources and a plurality of optical detectors that receive radiation from the illumination source that has been reflected from the image receiving surface. The radiation from the illumination source is usually visible light, but the radiation may be at or beyond either end of the visible light spectrum. If light is reflected by a white surface, the reflected light has the same spectrum as the illuminating light. In some systems, ink on the imaging surface may absorb a portion of the incident light, which causes the reflected light to have a different spectrum. In addition, some inks may emit radiation in a different wavelength than the illuminating radiation, such as when an ink fluoresces in response to a stimulating radiation. Each optical sensor generates an electrical signal that corresponds to the intensity of the reflected light received by the detector. The electrical signals from the optical detectors may be converted to digital signals by analog/digital converters and provided as digital image data to an image processor.

The environment in which the image data are generated is not pristine. Several sources of noise exist in this scenario and should be addressed in the registration process. For one, alignment of the printheads can deviate from an expected position significantly, especially when different types of imaging surfaces are used or when printheads are replaced. Additionally, not all inkjets in a printhead remain operational without maintenance. Thus, a need exists to continue to register the heads before maintenance can recover the missing jets. Also, some inkjets are intermittent, meaning the inkjet may fire sometimes and not at others. Inkjets also may not eject ink perpendicularly with respect to the face of the printhead. These off-angle ink drops land at locations other than were they are expected to land. Some printheads are oriented at an angle with respect to the width of the image receiving member. This angle is sometimes known as printhead roll in the art. The image receiving member also contributes noise. Specifically, structure in the image receiving surface and/or colored contaminants in the image receiving surface may be confused ink drops in the image data and lightly colored inks and weakly performing inkjets provide ink drops that contrast less starkly with the image receiving member than darkly colored inks or ink drops formed with an appropriate ink drop mass. Thus, improvements in printed images and the analysis of the image data corresponding to the printer images are useful for identifying printhead orientation deviations and printhead characteristics that affect the ejection of ink from a printhead. Moreover, image data analysis that enables correction of printhead issues or compensation for printhead issues is beneficial.

SUMMARY

A method analyzes image data corresponding to a test pattern generated on an image receiving member by a printer to identify positions for and registration between printheads in the printer. The method includes identifying a process direction position for each row of dashes in a plurality of rows of dashes in image data of a test pattern printed on an image receiving member, the test pattern being formed by each printhead in a printer forming at least one dash in each row of dashes in the plurality of rows of dashes, identifying a center of each dash in a cross-process direction, identifying an inkjet ejector that formed each dash in the row of dashes, identifying a process direction position for each printhead in the printer, identifying a cross-process displacement for each column of printheads, identifying a stitch displacement in the cross-process direction between neighboring printheads in a print bar unit that print a same color of ink, and operating an actuator to move at least some of the printheads in the printer with reference to the identified process direction positions, cross-process displacements, and the identified stitch displacements.

To produce the test pattern that enables the printhead positions to be identified, the printheads of a printer are operated in accordance with a method for printing a test pattern. The method includes operating at least one inkjet ejector in each printhead in a plurality of printheads to eject at least one dash in a row of dashes of a test pattern on an image receiving member, and continuing to operate the inkjet ejectors in the plurality of printheads until each inkjet ejector in each printhead has been operated to eject ink to form at least one dash in a row of dashes in the test pattern.

BRIEF DESCRIPTION OF THE DRAWINGS

The foregoing aspects and other features of a printer that generates a test pattern that better identifies printhead orientations and characteristics and that analyzes the image data corresponding to the generated test pattern are explained in the following description, taken in connection with the accompanying drawings.

DETAILED DESCRIPTION

Figure 1:
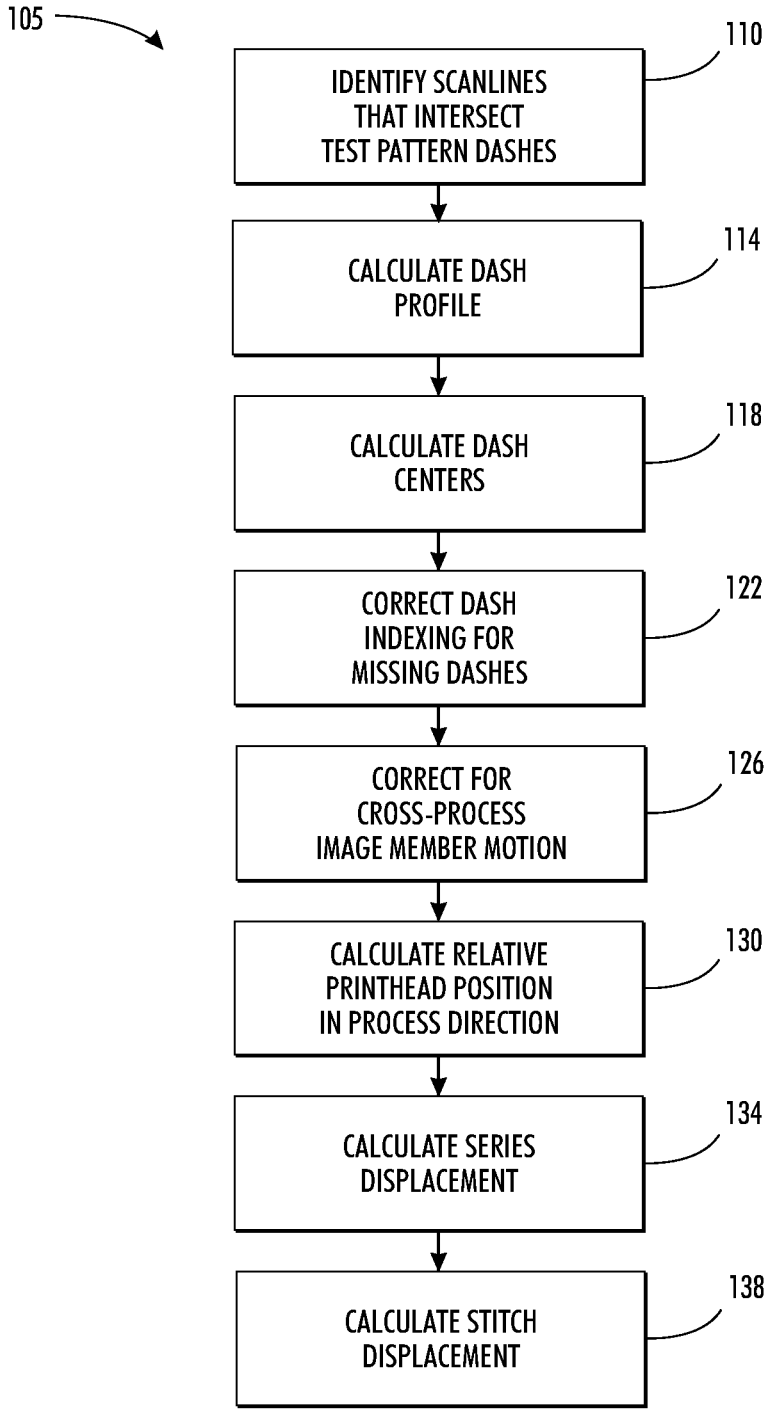
FIG. 1 is a flow diagram of a method for identifying positions of markings in test pattern.

A process 105 for analyzing image data of a test pattern is depicted in FIG. 1. Process 105 employs a sensor to analyze image data obtained from the surface of an image receiving member in a print system. This analysis enables the positions of the dashes to be determined more accurately and the positional information for the dashes may be used to determine the position and orientation of the printheads more accurately. The image data corresponding to a test pattern printed on an image receiving member may be generated by an optical sensor. The optical sensor may include an array of optical detectors mounted to a bar or other longitudinal structure that extends across the width of an imaging area on the image receiving member. In one embodiment in which the imaging area is approximately twenty inches wide in the cross process direction and the printheads print at a resolution of 600 dpi in the cross process direction, over 12,000 optical detectors are arrayed in a single row along the bar to generate a single scanline across the imaging member. The optical detectors are configured in association in one or more light sources that direct light towards the surface of the image receiving member. The optical detectors receive the light generated by the light sources after the light is reflected from the image receiving member. The magnitude of the electrical signal generated by an optical detector in response to light being reflected by the bare surface of the image receiving member is higher than the magnitude of a signal generated in response to light reflected from a drop of ink on the image receiving member. This difference in the magnitude of the generated signal may be used to identify the positions of ink drops on an image receiving member, such as a paper sheet, media web, or print drum. The reader should note, however, that lighter colored inks, such as yellow, cause optical detectors to generate lower contrast signals with reference to uncovered portions of the image receiving member than the contrast signals produced by darker colored inks, such as black, with reference to uncovered portions of the image receiving member. Thus, the contrast signal differences may be used to differentiate between dashes of different colors. The magnitudes of the electrical signals generated by the optical detectors may be converted to digital values by an appropriate analog/digital converter. These digital values are denoted as image data in this document and these data are analyzed to identify positional information about the dashes on the image receiving member as described below.

The ability to differentiate dashes of different ink colors is subject to the phenomenon of missing or weak inkjet ejectors. Weak inkjet ejectors are ejectors that do not respond to a firing signal by ejecting an amount of ink that corresponds to the amplitude or frequency of the firing signal delivered to the inkjet ejector. A weak inkjet ejector, instead, delivers a lesser amount of ink. Consequently, the lesser amount of ink ejected by a weak jet covers less of the image receiving member so the contrast of the signal generated by the optical detector with reference to an uncovered portion of the image receiving member is lower. Therefore, ink drops in a dash ejected by a weak inkjet ejector may result in an electrical signal having a magnitude that is different than that expected. Missing inkjet ejectors are inkjet ejectors that eject little or no ink in response to the delivery of a firing signal. A process for identifying the inkjet ejectors that fail to eject ink drops for the test pattern is discussed in more detail below.

Figure 2:
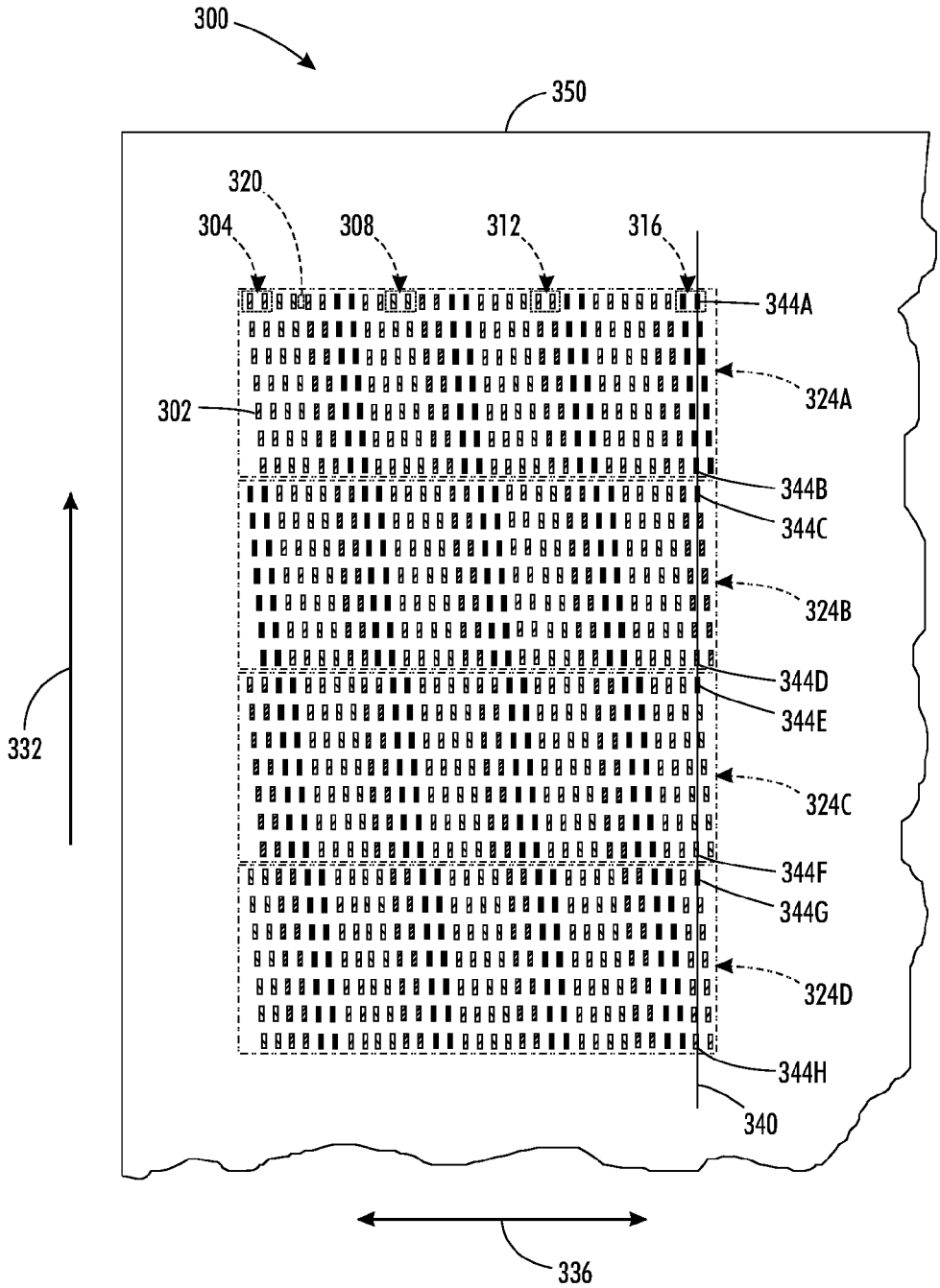
FIG. 2 is a sample test pattern suitable for use with the methods of FIG. 1.

An example test pattern suitable for use with an image analyzing process, such as process 105, is depicted in FIG. 2. Test pattern 300 includes a plurality of dashes, where each dash is formed from ink ejected from a single inkjet ejector in a printhead. The dashes 302 are formed in the print process direction 332, with multiple rows of dashes disposed along the cross-process axis 336. Test pattern 300 is configured for use with a printer using cyan, magenta, yellow, and black (CMYK) coloring stations. Test pattern 300 is further configured for use with ink coloring stations configured for interlaced printing using two printhead arrays for each of the CMYK colors. Dashes of the same color, one from each of the aligned printheads in each coloring station, are spaced adjacent to one another in each row of test pattern 300, as seen with cyan dashes 304, magenta dashes 308, yellow dashes 312, and black dashes 316. In FIG. 2, the dashes in each row of test pattern 300 are arranged in a ladder including seven (7) inkjet ejectors, such that one inkjet ejector in the inkjet printhead forms a dash, and the next dash in the row comes from an inkjet ejector that is offset by six (6) positions in the cross-process axis 336. The space 320 between consecutive dashes in a row of test pattern 300 is the width of the six non-printing inkjet ejectors. Alternative test patterns could employ ladders with a larger or smaller number of inkjet ejectors in each group producing a similar test pattern having multiple rows of dashes.

The length of the dashes 302 corresponds to the number of drops used to form a dash. The number of drops is chosen to produce a dash that is sufficiently greater in length than the resolution of an optical detector in the process direction. The distance imaged by an optical detector is dependent upon the speed of the image member moving past the detector and the line rate of the optical detector. A single row of optical detectors extending across the width of the imaging area on the image receiving member is called a scanline in this document. The dashes are generated with a length that is greater than a single scanline in the process direction so the dash image can be resolved in the image processing. Thus, multiple scanlines are required to image the entire length of the dashes in the process direction.

Rows in test pattern 300 may be grouped according to the ladder formation used to space dashes 302, as seen by groups 324A-324D. Each row in one of groups 324A-324D is offset by one inkjet ejector in the cross-process axis 336 from the preceding row. Each group has seven rows, allowing each inkjet ejector in a seven inkjet ejector series to form one dash. The number of groups is determined by the number of unique colors the printing system generates, with test pattern 300 showing an example for a CMYK printing system providing four groups, 324A, 324B, 324C, and 324D. The four groups 324A-324D allow each inkjet ejector in the printheads for every color (CMYK) to print a dash in test pattern 300. Thus, line 340 that is parallel to process direction 332 may be aligned to pass through the center of a dash of each color in the same cross-process position. Line 340 passes through the center of black dash 344A, and passes by the edge of black dash 344B. In relative terms, black dash 344A is formed by an inkjet ejector in first black printhead at the first position of a group of seven consecutive inkjet ejectors in the first printhead. Dash 344B corresponds to the seventh and final inkjet ejector of a previous group from the second black printhead, where the second black printhead is offset in the cross-process axis 336 by one-half the width that separates ejectors in each printhead. This offset allows the two black printheads to interlace dashes for full coverage of all locations under the printheads in the print zone.

Line 340 passes through yellow dashes 344C and 344D, magenta dashes 344E and 344F, and cyan dashes 344G and 344H in a similar manner to black dashes 344A and 344B. When aligned in the cross process direction, drops of various colored inks may be placed in the same location for color printing that produces secondary colors by mixing inks from the CMYK colors. Additionally, the interlaced arrangement of printheads enables side-by-side printing of ink drops to produce colors that extend the color gamut and hues available with the printer. The test pattern 300 of FIG. 2 may be repeated along the cross-process axis to include some or all of the inkjet ejectors from each printhead in a printzone used to form images on an image receiving member passing through the printzone.

Figure 3:
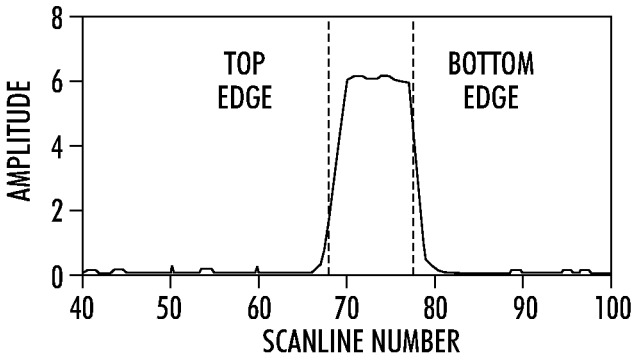
FIG. 3 is an illustration of an amplitude response signal for an optical detector imaging a dash in the test pattern of FIG. 1.

The process of 105 of FIG. 1 begins by identifying scanlines that intersect dashes in the test pattern (block 110). One way to extract the signal corresponding to the positions of the dashes is to convolve the signal profile for an optical detector in the cross-process direction with a cosine and a sine function having a periodicity at the expected periodicity of the dash profile. The squares of the individual convolutions are then summed and compared to a predetermined threshold to detect the presence of a dash. As used in this document, "convolution" refers to the summation of the product of two functions. Thus, the summation of the product of the profile function and sine function is computed and the summation of the product of the profile function and cosine function is computed. The squares of the magnitudes of these two convolutions are then added to produce a sum that is compared to the predetermined threshold. As shown in FIG. 3, the response of an optical detector for the scanlines prior to scanline 67 has a relatively low amplitude. For scanlines 67 to about scanline 81, the amplitude indicates the presence of a row of dashes before returning to the low amplitude value. A sine and cosine function having a period corresponding to a spacing between dashes in a row is selected for the convolution operations. In one embodiment, the convolution operation gives a maximum response when a period of 7 pixels is chosen in the cross process direction. The summation of the squares of the convolutions and the comparison to a threshold help ensure the amplitude of the detector profile is sufficient to indicate a dash line and not noise in the image data. The operations described on the detector profile are equivalent to a Fourier transform of the profile and detection of a peak at the period of the ladder chart. If the profile data show a frequency within a predefined range of the expected frequency, then the image data corresponds to dashes in the test pattern and the top and the bottom of each dash can be determined with reference to a scanline.

Figure 4:
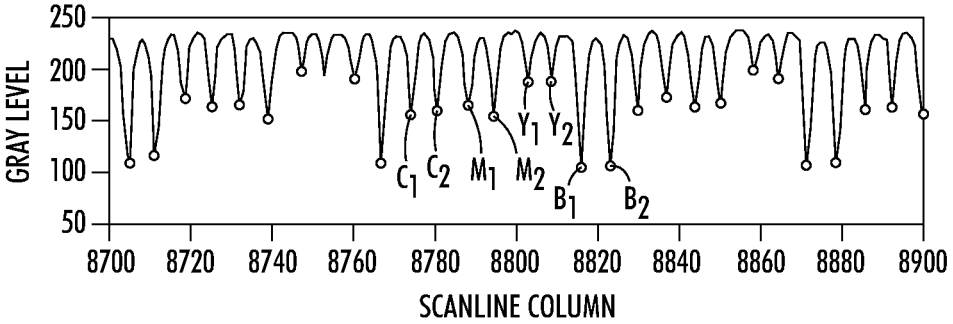
FIG. 4 is an illustration of a portion of a dash profile for a group of optical detectors imaging the test pattern of FIG. 1.

A dash profile is then identified with reference to the optical detector responses (block 114). The gray level responses of the optical detector between the top and the bottom of each detected dash are averaged and these averages are mapped across the optical detector array. An example of this mapping is shown in FIG. 4. In the portion shown in FIG. 4, the optical detectors corresponding to a local minimum in the gray level function are identified as corresponding to the dash positions in the cross-process direction. That is, the gray level is higher at detectors sensing a portion of the image receiving member that has little or no ink on it and the lower values occur where ink drops are present. Thus, the yellow dashes $Y_1$ and $Y_2$ present local minima that have an average gray level that is higher than the average gray level for other inks $C_1$, $C_2$, $M_1$, $M_2$, $B_1$, and $B_2$ that provide more contrast. The mapping shown in FIG. 4 depicts a profile through the dashes and may be called a dash profile.

Figure 5:
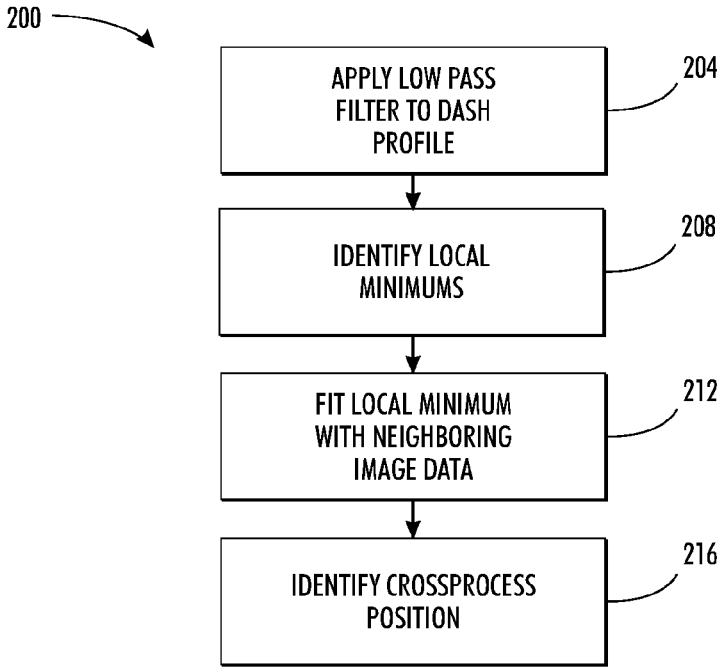
FIG. 5 is a flow diagram of a method for locating the cross-process position of a dash in a test pattern row.

The generated dash profile is further analyzed to determine the cross-process locations corresponding to the centers of each dash in the dash profile (block 118). A filtering and interpolation process, such as the one shown in FIG. 5, may be used to locate the center of each dash. In FIG. 5, process 200 begins by convolving the dash profile data with a low-pass filter kernel function (block 204). The low-pass filtering convolution serves to smooth the scanline data further, eliminating sudden spikes in image data values that are caused by noise instead of by dashes in the image data. A series of local minima are located in the filtered image data (block 208). Each local minimum, identified by the dots in FIG. 3, corresponds to a center of a dash in the filtered image data at the resolution of the optical detectors. To identify the center of a dash more specifically, the local minimum is interpolated with reference to the gray level values from the neighboring pixels on each side of the identified local minima (block 212). This interpolation may be performed by fitting these three data values to a curve to identify the local minimum more precisely. In one interpolation scheme, a quadratic curve is used for the interpolation. The cross-process position of the minimum value of the fitted curve is calculated and stored as the center of a dash in the test pattern (block 216). The processing of blocks 208-216 are carried out for each local minimum identified in the filtered image data.

The process 105 of FIG. 1 continues by correcting the detected dash indices for missing dashes (block 122). A dash may be missing from the image data for a variety of reasons, but frequently a dash is absent because the inkjet ejector intended to print a dash fails to eject ink in response to a firing signal. The absence and identification of missing dashes may be obtained using several known properties of the test pattern. For one, a larger than expected distance separates the centers of detected dashes in the neighborhood of a missing dash or dashes. If the inter-dash distance exceeds the expected distance by a wide enough margin, then one or more ejectors are deemed to be missing from the test pattern. Another property that may be used is the contrast demonstrated by a dash profile. As noted above, the dash centers correspond to different local minimum values by ink color. Thus, the process is able to use these differing contrast values to identify the color of a missing dash. Accordingly, the number of dashes in an area, the distance between dashes in the area, and the contrast values for the dashes in the area may be used to identify missing dashes and the inkjet ejectors that should have printed the missing dash or dashes. The indices of the identified inkjet ejectors are adjusted to take into account the missing dashes. For example, in an array of seven expected dashes where dashes expected at indices 4 and 5 are missing, the centers of dashes 3 and 6 are separated by a distance of approximately three times the normally expected distance. Instead of incorrectly identifying ejector 6 as ejector 4, the process 105 detects the missing dashes and assigns the correct index to ejector 6. Inkjet ejectors that do not generate detected dashes may be indexed separately in order to compensate for inoperable inkjet ejectors or to signal that a printhead is faulty.

As seen in FIG. 2, a full test pattern arrangement including all inkjet ejectors in every printhead has a plurality of rows, such as the twenty-eight rows depicted in test pattern 300. The image receiving member that receives the test pattern moves in the process direction 332 under the ink stations in the print zone. However, the image receiving member may also drift along the cross-process axis 336 as the dashes for the test pattern are formed. Cross-process drift errors may accumulate between rows in the test pattern, resulting in inaccurate measurements of the cross-process positions for dashes in different rows.

Process 105 measures and corrects for cross-process displacement caused by drift in the image receiving member (block 126). To measure the magnitude and direction of media drift, the average detected cross-process positions of every dash in a row of test dashes are compared to the expected average positions for the dashes with reference to the first row of dashes. Cross-process displacement is the difference between the measured average position and the expected average position. Averaging the positions of the entire row of dashes distinguishes errors in imaging the test pattern that occur due to media drift from errors that may occur with misalignment in a smaller group of ejectors or a single printhead.

Figure 6:
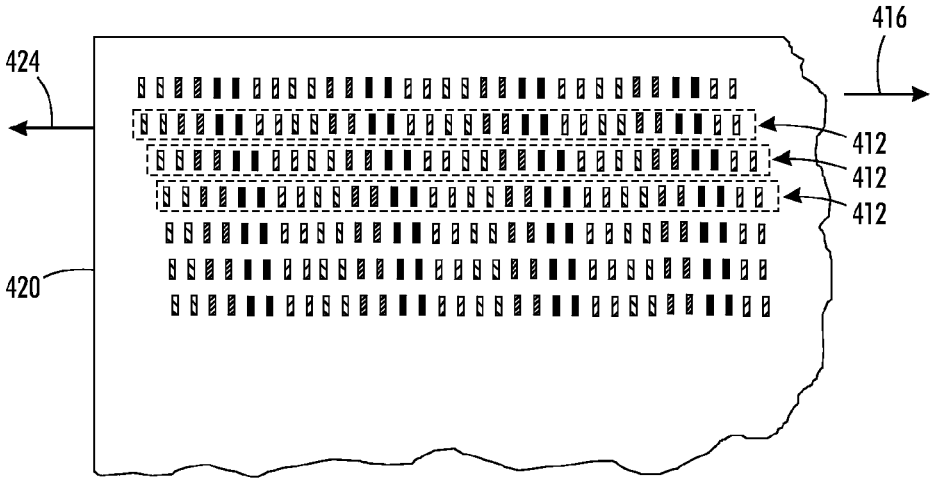
FIG. 6 is a portion of a sample test pattern having a cross-process offset between rows of the test pattern.

An example of a portion of a test pattern with a row displaced due to cross-process media drift is depicted in FIG. 6. Test pattern row 404 is formed on an image receiving member, and subsequent cross-process direction drift causes an offset for all subsequent rows including rows 408 and 412. Row 408 is offset as indicated by arrow 416. The cross-process offset calculations determine that the average position of dashes in row 408 is offset from the expected average position, even though the dashes in row 408 are in the correct positions relative to each other. Subsequent rows such are row 412 are then in a relative position that aligns with row 408.

The process 105 cancels out the effects of media drift by adjusting the detected cross-process positions of dashes in the opposite direction and magnitude of the detected offset. From the example of FIG. 6, if row 408 has a cross-process offset of 30 μm in the direction of arrow 416, then the center positions of each dash in the row 408 are adjusted by 30 μm in the opposite direction of arrow 416. The same correction may be applied to subsequent rows such as row 412 to remove errors introduced from cross-process drift for the remaining portion of the test pattern.

The determination of cross-process positions for each ejector in a printing system detailed in blocks 114-126 allows for adjustment of the locations of each droplet crossing an imaging receiving member moving in the process direction. Each dash in a test pattern also occupies a position in the process direction. Unlike the cross-process direction where absolute positions for each ejector are determined, the determination of printhead positions in the process direction is based on the relative positions of the respective printheads. Relative positions are determined because an image receiving member moves past the printheads in a print zone in the process direction, allowing a printhead to eject ink onto any position along the process direction by timing when each ink droplet is ejected. Proper timing allows droplets from multiple printheads to be aligned in even rows, preventing unintended over-prints or uneven rows where different printheads fire either too early or too late to form a uniform row. Printheads that are aligned in the process direction also allow for intentional overprinting, or drop-on-drop printing, where a drop from one printhead mixes with a drop from a different printhead to produce a new color. For example, a drop from a cyan printhead may be ejected first, with a later drop from a corresponding yellow printhead depositing on the cyan drop to form an ink mass that appears to be green. If the relative positions of the printheads are known, the printing system may adjust the operations of the cyan and yellow ejectors to produce the drop-on-drop result.

Figure 7:
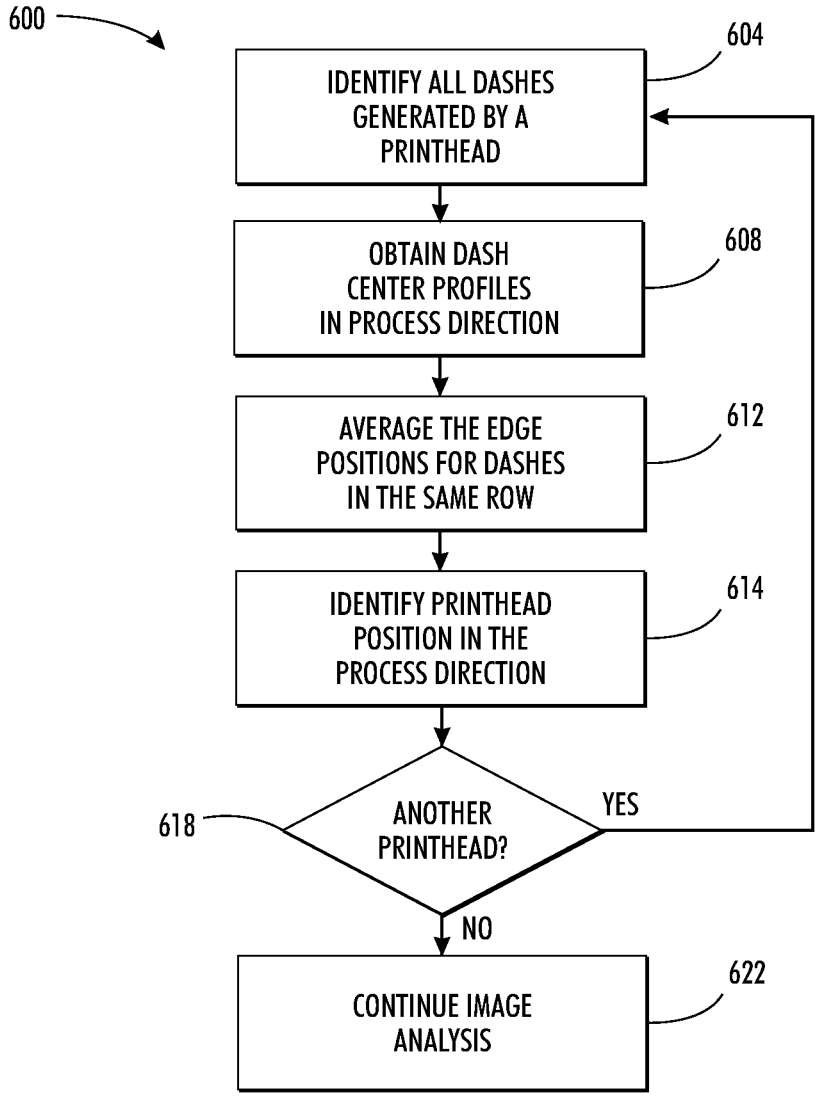
FIG. 7 is a flow diagram of a method for locating the relative position of a printhead in the process direction.

The registration process 105 determines the relative position of each of the printheads in the process direction (block 130). A test pattern such as test pattern 300 from FIG. 2 may be used to detect the offset of each printhead relative to other printheads in the process direction. An example process 600 for determining the relative position of each printhead in the process direction is shown in FIG. 7. Process 600 begins by identifying all dashes belonging to a single printhead in a test pattern, such as test pattern 300 from FIG. 2 (block 604). As an example, two cyan dashes 304 shown as a pair come from different cyan printheads, with the pattern of dash pair 304 repeated throughout test pattern 300. The left-most detected dash in every pair of cyan dashes present in the test pattern belongs to a single cyan printhead, while the right-most dash belongs to another cyan printhead. Once each dash belonging to a single printhead is identified, a profile of the optical detector closest to the center of each dash, as previously identified by the interpolation around the local minima of FIG. 4, for example, is obtained in the process direction (block 608). Each profile is convolved with an edge detection kernel to identify a top or a bottom of each dash in process direction. As used in this document, "edge detection kernel" refers to a function that is defined so the convolution of the dash profile and the edge detection kernel function is a minimum at the start of a dash in a column in the process direction. The convolution with the edge detection kernel identifies a local minimum where the start position of dash occurs on the portion of the image receiving member underlying the optical detector. Similarly, the end position of each dash may be identified by a convolution with an end edge detection kernel. The end edge kernel is the inverse of the start edge kernel. For the dashes generated by the inkjet nozzles in the same row of the printhead being evaluated, the detected edge positions of the dashes are averaged to reduce the impact of alignment variances in individual ejectors (block 612). From these row positions, the center of the printhead in the process direction is calculated (block 614). If the process direction position of additional printheads needs to be computed for other printheads (block 618), the process continues (block 604). Otherwise, the image analysis process of FIG. 1 continues (block 622).

Once the process direction positions of the printheads are determined, the analysis process 105 identifies the series alignment of different printheads in the print zone (block 134). Series alignment is defined as the cross-process alignment of corresponding ejectors used in corresponding printheads in the print zone. In the test pattern shown in FIG. 2, line 340 passes through a single print column including the center of black dash 344A, yellow dash 344C, magenta dash 344E, and cyan dash 344G. Each of these dashes is generated by an inkjet ejector having the same target position in a printhead of each of the CMYK colors. The dashes in a print column are in series alignment because they each have the same cross-process positions, allowing line 340 to pass through the center of each dash.

While test pattern 300 shows dashes aligned along cross-process axis 336, dashes belonging to corresponding inkjet ejectors in a print column may be misaligned due to variances in the cross-process positions of different printheads. Using the detected cross-process profiles of test pattern dashes, process 105 compares the cross-process positions from a reference printhead to the cross-process profiles of a second printhead in a print column. A print column corresponds to the printheads arranged in the process direction that are opposite roughly the same portion of the image receiving member. If there is a misalignment between the two printheads, then a portion of the printhead inkjet ejectors overlap one another. To determine series alignment, one printhead is selected as a reference printhead and a common set of nozzles printed between the reference head and any other head in the print column are identified. For example, if each head has 880 nozzles, and nozzle 1 on the reference head is aligned with nozzle 11 on another head, then 870 nozzles in each printhead are in the overlap region. Next, the difference between the measured nozzle spacing and the expected nozzle spacing is calculated for each pair of nozzles in the two printheads in the overlap region. These measured differences are averaged to give the relative head offset in each print column. The relative head offsets between each head in the print column and the reference head are adjusted so the mean of the relative head offsets sum to zero. The relative head offsets are adjusted by modifying the positions of one or more of the printheads in the print column.

The printheads may be adjusted in the cross-process direction using actuators, such as electrical motors, that are operatively connected to a printhead or to a mounting member to which a printhead is mounted. These actuators are typically electro-mechanical devices that respond to control signals that may be generated by a controller configured to implement process 105. In one embodiment, each printhead may be operatively connected to an independent actuator. In alternative embodiments, a group of two or more printheads, typically mounted to a single printhead bar, may be operatively connected to a single actuator to enable movement of the printhead group with the single actuator. All but one of the printheads are further mechanically coupled to independent secondary actuators, with the printhead not having an independent actuator being adjusted solely by the first actuator. This arrangement allows the first actuator to adjust all of the coupled printheads simultaneously, with the secondary independent actuators providing further adjustments to their respective printheads.

Figure 11:
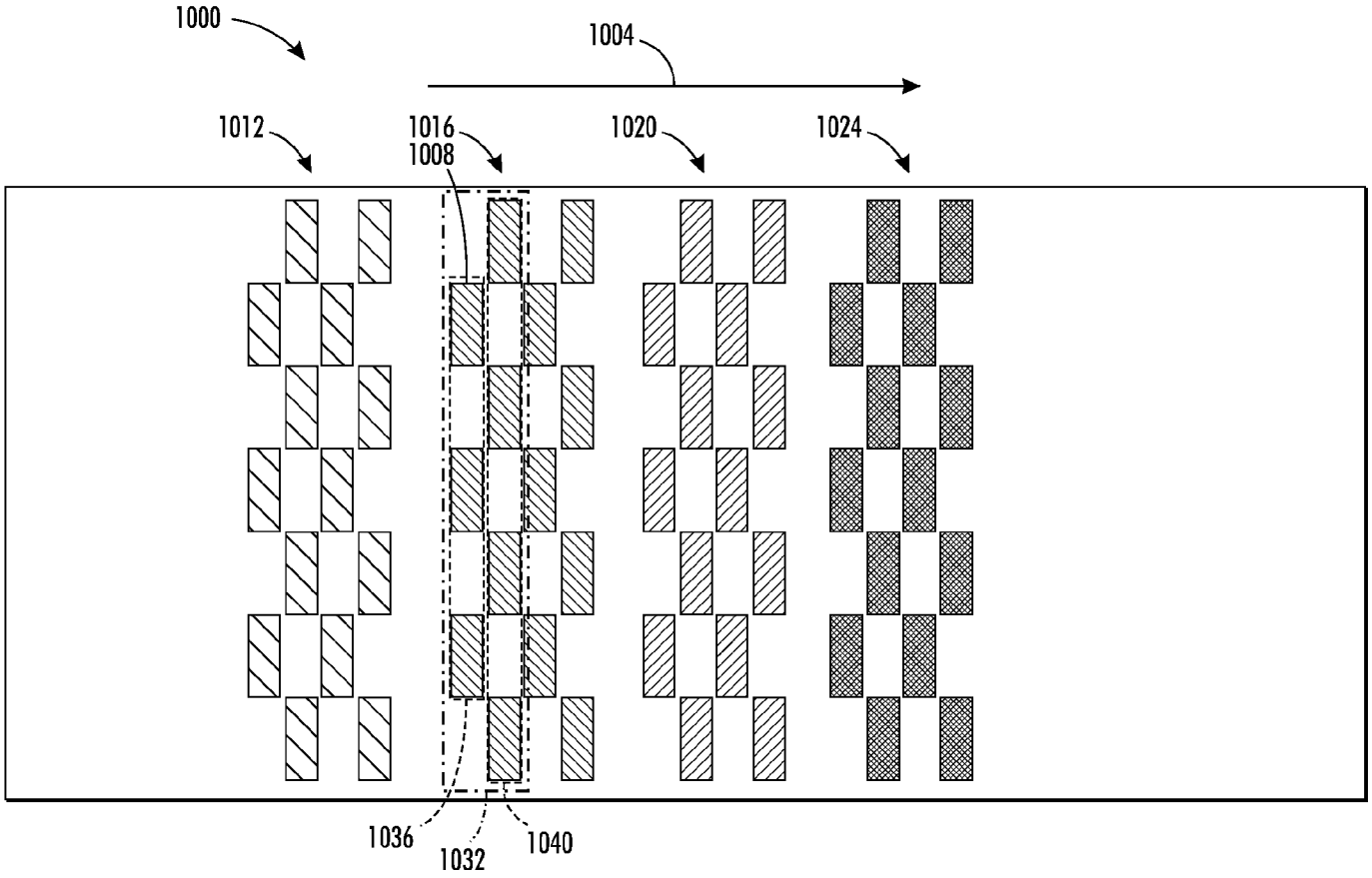
FIG. 11 PRIOR ART
FIG. 11 is a schematic view of a prior art printhead configuration.

Another form of printhead alignment in the cross-process direction is known as stitch alignment. Stitch alignment occurs at the interface boundaries between adjacent printheads in a print array. Many printhead configurations arrange multiple printheads on different rows in a single array to span the entire cross-process width of an image receiving member that passes through the print zone. The multiple printheads are "stitched" together to form a seamless line in the cross process direction. For example, the rightmost inkjet ejectors of printhead 1040 in FIG. 11 can eject ink drops that are adjacent ink drops ejected by the leftmost inkjet ejectors of printhead 1036. Stitch error arises when a gap or overlap exists between edge nozzles of neighboring heads of the same color.

Figure 8:
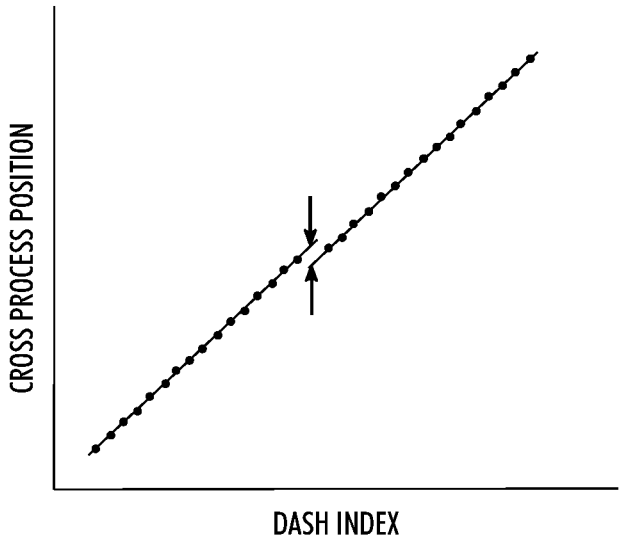
FIG. 8 illustrates a method of computing a stitch displacement between two printheads across a stitch interface.

In process 105 of FIG. 1, X-stitch alignment is calculated from the measurements of the dash position measurements in the cross process direction (block 138). One method of calculating this alignment is illustrated in FIG. 8. For each stitch interface between printheads, the cross process position of the rightmost sixteen nozzles of the printhead on the left side of the stitch interface is plotted against the nozzle index. Nozzle index refers to a number assigned to an inkjet ejector to identify each inkjet ejector uniquely. For example, in a printhead having 880 inkjet ejectors, the inkjet ejectors may be uniquely assigned a number in the range of 1-880. In this plot, the cross process position of the sixteen nozzles of the printhead on the right side of the stitch interface is plotted against the nozzle index. A line is fit through each group of sixteen nozzles and extrapolated to the interface. The difference between the two extrapolated lines is defined as the stitch displacement.

Figure 9:
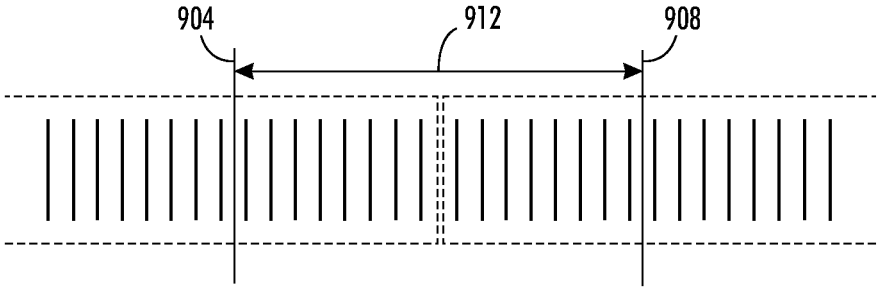
FIG. 9 illustrates an alternative method of computing a stitch displacement between two printheads across a stitch interface.

An alternative calculation of stitch displacement is shown in FIG. 9. In this process, the mean position 904 of the rightmost sixteen nozzles on the printhead on the left side of the stitch interface may be calculated and the mean position 908 of the leftmost sixteen nozzles on the printhead on the right side of the stitch interface may also be calculated. The expected spacing between the mean positions should correspond to sixteen jets. The difference between the measured spacing 912 and the expected spacing is the stitch displacement. Although two processes are described for the computation of stitch displacement, other processes are possible. While the method for computation of the stitch method has been discussed with reference to a group of sixteen nozzles in each printhead on either side of the stitch interface, other numbers of nozzles may be used. Regardless of method, the stitch displacement calculation is performed for each stitch interface in the printer (block 138, FIG. 1).

In operation, the image analysis process 105 of FIG. 1 may be carried out at regular intervals to allow the printheads to compensate for drift that occurs during normal operation. The adjustment process may also be conducted in response to a signal to print test patterns and adjust the printheads generated by a user of the printer. In some embodiments, the test pattern arrangements depicted herein may be printed on portions of an image receiving member that are normally discarded after the printing process. For example, inter-document gaps in web printing systems may include arrangements of test patterns used for registering printheads. An inter-document gap may be the small region between document regions that is cut away when a continuous web of paper is cut into individual sheets. The rows of the test pattern may be distributed among the individual regions that are cut away. One or more rows of the test pattern may be printed in the cut away region.

Figure 10:
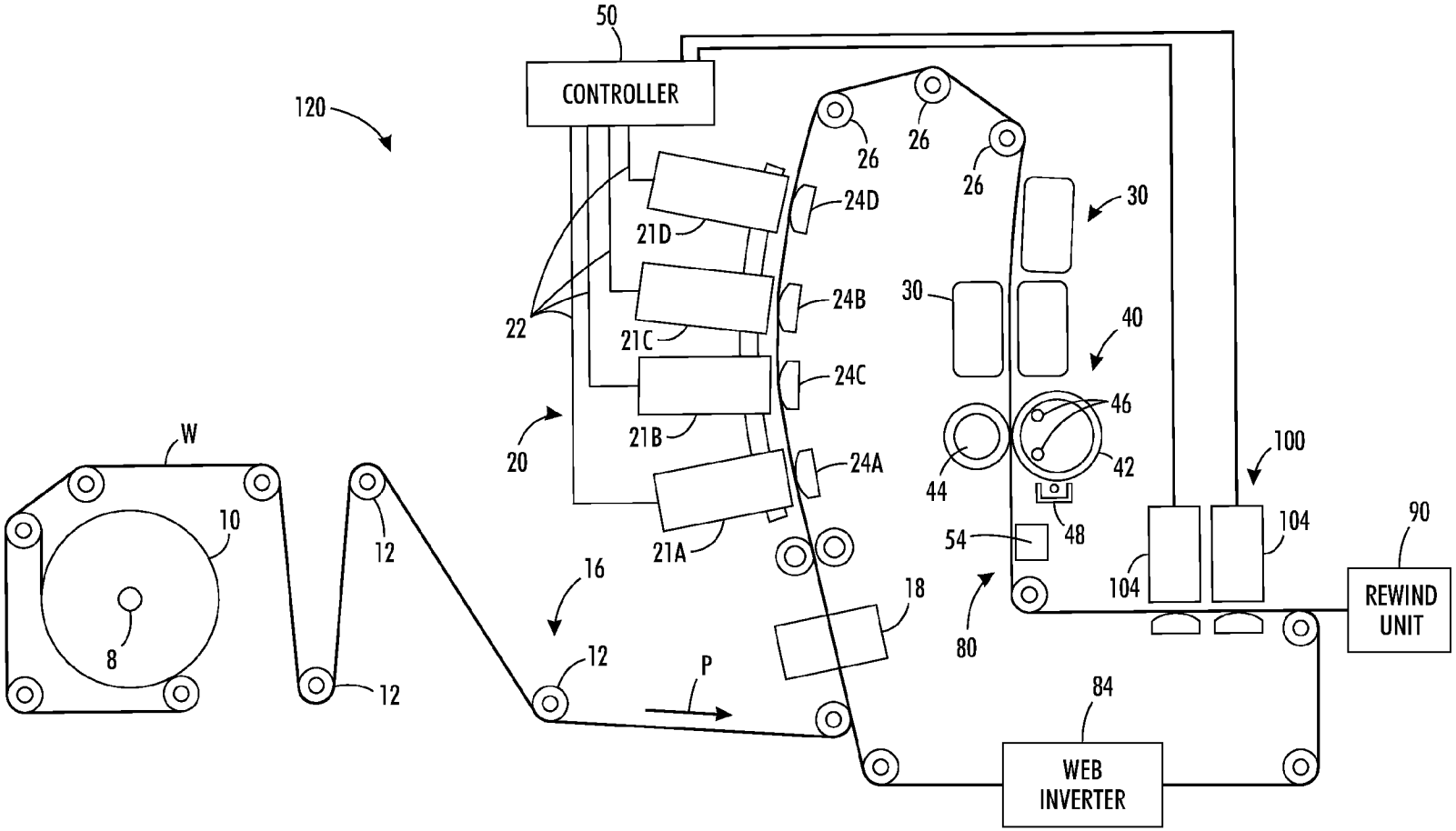
FIG. 10 PRIOR ART
FIG. 10 is a schematic view of a prior art inkjet imaging system that ejects ink onto a continuous web of media as the media moves past the printheads in the system.

Referring to FIG. 10, a prior art inkjet imaging system 120 is shown. For the purposes of this disclosure, the imaging apparatus is in the form of an inkjet printer that employs one or more inkjet printheads and an associated solid ink supply. However, the systems and methods described herein are applicable to any of a variety of other imaging apparatus that use inkjets to eject one or more colorants to a medium or media. The imaging apparatus includes a print engine to process the image data before generating the control signals for the inkjet ejectors. The colorant may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

FIG. 10 is a simplified schematic view of a direct-to-sheet, continuous-media, phase-change inkjet imaging system 120, that may be modified to generate the test patterns and adjust printheads using the methods discussed above. A media supply and handling system is configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 100, and rewind unit 90. For duplex operations, the web inverter 84 is used to flip the web over to present a second side of the media to the printing station 20, printed web conditioner 80, and coating station 100 before being taken up by the rewind unit 90. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 100 before being flipped by the inverter 84 and laterally displaced by a distance that enables the web to travel over the other half of the rollers opposite the printing station 20, printed web conditioner 80, and coating station 100 for the printing, conditioning, and coating, if necessary, of the reverse side of the web. The rewind unit 90 is configured to wind the web onto a roller for removal from the printer and subsequent processing.

The media may be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a expected path through the imaging device. The pre-heater 18 brings the web to an initial predetermined temperature that is selected for desired image characteristics corresponding to the type of media being printed as well as the type, colors, and number of inks being used. The pre-heater 18 may use contact, radiant, conductive, or convective heat to bring the media to a target preheat temperature, which in one practical embodiment, is in a range of about 30° C. to about 70° C.

The media are transported through a printing station 20 that includes a series of printhead modules 21A, 21B, 21C, and 21D, each printhead module effectively extending across the width of the media and being able to place ink directly (i.e., without use of an intermediate or offset member) onto the moving media. As is generally familiar, each of the printheads may eject a single color of ink, one for each of the colors typically used in color printing, namely, cyan, magenta, yellow, and black (CMYK). The controller 50 of the printer receives velocity data from encoders mounted proximately to rollers positioned on either side of the portion of the path opposite the four printheads to compute the position of the web as moves past the printheads. The controller 50 uses these data to generate timing signals for actuating the inkjet ejectors in the printheads to enable the four colors to be ejected with a reliable degree of accuracy for registration of the differently color patterns to form four primary-color images on the media. The inkjet ejectors actuated by the firing signals corresponds to image data processed by the controller 50. The image data may be transmitted to the printer, generated by a scanner (not shown) that is a component of the printer, or otherwise generated and delivered to the printer. In various possible embodiments, a printhead module for each primary color may include one or more printheads; multiple printheads in a module may be formed into a single row or multiple row array; printheads of a multiple row array may be staggered; a printhead may print more than one color; or the printheads or portions thereof can be mounted movably in a direction transverse to the process direction P, such as for spot-color applications and the like.

The printer may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each printhead module is a backing member 24A-24D, typically in the form of a bar or roll, which is arranged substantially opposite the printhead on the back side of the media. Each backing member is used to position the media at a predetermined distance from the printhead opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the printheads of the printing station 20, the temperature of the media is maintained within a given range. Ink is ejected from the printheads at a temperature typically significantly higher than the receiving media temperature. Consequently, the ink heats the media. Therefore other temperature regulating devices may be employed to maintain the media temperature within a predetermined range. For example, the air temperature and air flow rate behind and in front of the media may also impact the media temperature. Accordingly, air blowers or fans may be utilized to facilitate control of the media temperature. Thus, the media temperature is kept substantially uniform for the jetting of all inks from the printheads of the printing station 20. Temperature sensors (not shown) may be positioned along this portion of the media path to enable regulation of the media temperature. These temperature data may also be used by systems for measuring or inferring (from the image data, for example) how much ink of a given primary color from a printhead is being applied to the media at a given time.

Following the printing zone 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIG. 10, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35° C. to about 80° C. In alternative embodiments, the fixing assembly may be configured to spread the ink using non-contact heating (without pressure) of the media after the print zone. Such a non-contact fixing assembly may use any suitable type of heater to heat the media to a desired temperature, such as a radiant heater, UV heating lamps, and the like.

In one practical embodiment, the roller temperature in spreader 40 is maintained at a temperature to an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi lbs/side. Lower nip pressure gives less line spread while higher pressure may reduce pressure roller life.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page. In one possible embodiment, the mid-heater 30 and spreader 40 may be combined into a single unit, with their respective functions occurring relative to the same portion of media simultaneously. In another embodiment the media is maintained at a high temperature as it is printed to enable spreading of the ink.

The coating station 100 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 100 may apply the clear ink with either a roller or a printhead 104 ejecting the clear ink in a pattern. Clear ink for the purposes of this disclosure is functionally defined as a substantially clear overcoat ink that has minimal impact on the final printed color, regardless of whether or not the ink is devoid of all colorant. In one embodiment, the clear ink utilized for the coating ink comprises a phase change ink formulation without colorant. Alternatively, the clear ink coating may be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink may be heated to about 100° C. to 140° C. to melt the solid ink for jetting onto the media.

Following passage through the spreader 40 the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 120 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the difference minimization function, described above. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

The imaging system 120 may also include an optical sensor 54. The drum sensor is configured to detect, for example, the presence, intensity, and/or location of ink drops jetted onto the receiving member by the inkjets of the printhead assembly. In one embodiment, the optical sensor includes a light source and a light detector. The light source may be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment may include three linear arrays, one for each of the colors red, green, and blue. Alternatively, all of the LEDS may be arranged in a single linear array in a repeating sequence of the three colors. The LEDs of the light source may be coupled to the controller 50 or some other control circuitry to activate the LEDs for image illumination.

The reflected light is measured by the light detector in optical sensor 54. The light sensor, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array may be configured to translate across the image substrate. For example, the linear array may be mounted to a movable carriage that translates across image receiving member. Other devices for moving the light sensor may also be used.

A reflectance may be detected by the light detector in optical sensor 54 that corresponds to each ink jet and/or to each pixel location on the receiving member. The light sensor is configured to generate electrical signals that correspond to the reflected light and these signals are provided to the controller 50. The electrical signals may be used by the controller 50 to determine information pertaining to the ink drops ejected onto the receiving member as described in more detail below. Using this information, the controller 50 may make adjustments to the image data to alter the generation of firing signals to either retard or quicken the ejection of an ink drop or drops from an inkjet ejector.

A schematic view of a prior art print zone 1000 that may be modified to use the test patterns described above is depicted in FIG. 11. The print zone 1000 includes four color units 1012, 1016, 1020, and 1024 arranged along a process direction 1004. Each color unit ejects ink of a color that is different than the other color units. In one embodiment, color unit 1012 ejects cyan ink, color unit 1016 ejects magenta ink, color unit 1020 ejects yellow ink, and color unit 1024 ejects black ink. The process direction is the direction that an image receiving member moves as travels under the color unit from color unit 1012 to color unit 1024. Each color unit includes two print arrays, which include two print bars each that carry multiple printheads. For example, the printhead array 1032 of the magenta color unit 1016 includes two print bars 1036 and 1040. Each print bar carries a plurality of printheads, as exemplified by printhead 1008. Print bar 1036 has three printheads, while print bar 1040 has four printheads, but alternative print bars may employ a greater or lesser number of printheads. The printheads on the print bars within a print array, such as the printheads on the print bars 1036 and 1040, are staggered to provide printing across the image receiving member at a first resolution. The printheads on the print bars with the print array 1034 within color unit 1016 are interlaced with reference to the printheads in the print array 1032 to enable printing in the colored ink across the image receiving member in the cross process direction at a second resolution. The print bars and print arrays of each color unit are arranged in this manner. One printhead array in each color unit is aligned with one of the printhead arrays in each of the other color units. The other printhead arrays in the color units are similarly aligned with one another. Thus, the aligned printhead arrays enable drop-on-drop printing of different primary colors to produce secondary colors. The interlaced printheads also enable side-by-side ink drops of different colors to extend the color gamut and hues available with the printer.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for analyzing image data of a test pattern generated by a printer comprising:

generating with an optical sensor image data of a test pattern having a plurality of rows of dashes, the test pattern being formed on an image receiving member by each printhead in a plurality of printheads within a printer that form the test pattern with at least one dash in each row of dashes in the plurality of rows of dashes;

identifying a process direction position for each row of dashes in the plurality of rows of dashes in the image data of the test pattern on the image receiving member;

identifying a center of each dash in a cross-process direction;

identifying an inkjet ejector that formed each dash in the row of dashes;

identifying a process direction position for each printhead in the printer by convolving a portion of the image data of the test pattern that corresponds to a response of an optical detector to light reflected by the image receiving member with a cosine function and a sine function having a period corresponding to spacing between dashes in a row, summing a square of each convolution, and identifying the position of the dash as corresponding to the position where the sum of the squares of the convolutions is greater than a threshold;

identifying a cross-process displacement for each column of printheads;

identifying a stitch displacement in the cross-process direction between neighboring printheads in a print bar unit that print a same color of ink; and operating an actuator to move at least some of the printheads in the printer with reference to the identified process direction positions, cross-process displacements, and the identified stitch displacements.

2. The method of claim 1, the identification of the center of each dash further comprising:

generating a profile through a row of dashes;

identifying a minimum image data value for each dash in the generated profile in a cross-process direction and an optical detector that generated the minimum image data value;

fitting a curve to the identified minimum image data value for a dash and two image data values, the two image data values corresponding to responses of two optical detectors, one detector being positioned on each side of the optical detector that generated the minimum image data value; and identifying a minimum value of the fitted curve as the center of the dash corresponding to the minimum image data value.

3. The method of claim 2 wherein the curve is a quadratic curve.

4. The method of claim 1 further comprising:

identifying a position in a row of dashes corresponding to a missing dash in the row of dashes; and identifying an inkjet ejector that failed to eject ink for the missing dash.

5. The method of claim 4 further comprising:

adjusting the identification of the inkjet ejectors that formed each dash in the row of dashes with reference to the inkjet ejector identified with the missing dash.

6. The method of claim 1, the identification of the stitch displacement between neighboring printheads further comprising:

associating a cross-process position for each leftmost inkjet ejector in a first printhead with an index for each leftmost inkjet ejector;

associating a cross-process position for each rightmost inkjet ejector in a second printhead that is a next nearest printhead left of the first printhead in the cross-process direction with an index for each rightmost inkjet ejector; and identifying the stitch displacement by computing a vertical displacement between the two associations at an interface between the first and the second printheads.

7. A method for analyzing image data of a test pattern generated by a printer comprising:

generating with an optical sensor image data of a test pattern having a plurality of rows of dashes, the test pattern being formed on an image receiving member by each printhead in a plurality of printheads within a printer that form the test pattern with at least one dash in each row of dashes in the plurality of rows of dashes;

identifying a process direction position for each row of dashes in the plurality of rows of dashes in the image data of the test pattern on the image receiving member;

identifying a center of each dash in a cross-process direction;

identifying an inkjet ejector that formed each dash in the row of dashes;

identifying a process direction position for each printhead in the printer;

identifying a cross-process displacement for each column of printheads;

identifying a stitch displacement in the cross-process direction between neighboring printheads in a print bar unit that print a same color of ink;

identifying a cross-process direction displacement for a row of dashes in the image data corresponding to the test pattern, the cross-process direction displacement being identified with reference to one row selected from the plurality of rows of dashes;

adjusting identified dash positions in the row of dashes with reference to the identified cross-process direction displacement for the row of dashes; and operating an actuator to move at least some of the printheads in the printer with reference to the identified process direction positions, identified cross-process displacements for each column of printheads, and the identified stitch displacements.

8. The method of claim 7, the identification of the cross-process displacement for a row of dashes further comprising:

computing an average center of mass for a row of dashes;

generating the cross-process direction displacement for the row of dashes as a difference between the computed average center or mass for the row of dashes and an expected center of mass for the row of dashes.

9. A method for analyzing image data of a test pattern generated by a printer comprising:

generating with an optical sensor image data of a test pattern having a plurality of rows of dashes, the test pattern being formed on an image receiving member by each printhead in a plurality of printheads within a printer that form the test pattern with at least one dash in each row of dashes in the plurality of rows of dashes;

identifying a process direction position for each row of dashes in the plurality of rows of dashes in the image data of the test pattern on the image receiving member;

identifying a center of each dash in a cross-process direction;

identifying an inkjet ejector that formed each dash in the row of dashes;

identifying a cross-process displacement for each column of printheads;

identifying a stitch displacement in the cross-process direction between neighboring printheads in a print bar unit that print a same color of ink;

identifying a process direction position for each printhead in the printer by:

identifying each dash in the image data corresponding to the test pattern that was formed with ink ejected from one printhead in the printer;

generating a density profile through a center of each dash;

convolving a kernel with each density profile to identify a minimum value corresponding to the kernel; and averaging the minimum values for each convolution to identify the process direction position for the one printhead;

operating an actuator to move at least some of the printheads in the printer with reference to the identified process direction positions, identified cross-process displacements for each column of printheads, and the identified stitch displacements; and adjusting firing signals generated to operate inkjet ejectors in a printhead to decrease the identified positional differences between ink drops ejected by different printheads.

10. A method for analyzing image data of a test pattern generated by a printer comprising:

generating with an optical sensor image data of a test pattern having a plurality of rows of dashes, the test pattern being formed on an image receiving member by each printhead in a plurality of printheads within a printer that form the test pattern with at least one dash in each row of dashes in the plurality of rows of dashes;

identifying a process direction position for each row of dashes in the plurality of rows of dashes in the image data of the test pattern on the image receiving member;

identifying a center of each dash in a cross-process direction;

identifying an inkjet ejector that formed each dash in the row of dashes;

identifying a stitch displacement in the cross-process direction between neighboring printheads in a print bar unit that print a same color of ink;

identifying a process direction position for each printhead in the printer;

identifying a cross-process displacement for each column of printheads by:

selecting a reference printhead from the printheads in the column of printheads;

computing a difference between inkjet ejector positions in the reference printhead and inkjet ejector positions in another printhead in the column of printheads for the inkjet ejectors in the reference printhead that overlap with the inkjet ejectors in the other printhead;

averaging the computed differences to identify the cross-process displacement for each printhead other than the reference printhead in the column of printheads; and operating a plurality of actuators to move the printheads other than the reference printhead in the column of printheads by distances that sum the average computed differences to zero; and operating an actuator to move at least some of the printheads in the printer with reference to the identified process direction positions, identified cross-process displacements for each column of printheads, and the identified stitch displacements.

11. A method for analyzing image data of a test pattern generated by a printer comprising:

generating with an optical sensor image data of a test pattern having a plurality of rows of dashes, the test pattern being formed on an image receiving member by each printhead in a plurality of printheads within a printer that form the test pattern with at least one dash in each row of dashes in the plurality of rows of dashes;

identifying a process direction position for each row of dashes in the plurality of rows of dashes in the image data of the test pattern on the image receiving member;

identifying a center of each dash in a cross-process direction;

identifying an inkjet ejector that formed each dash in the row of dashes;

identifying a process direction position for each printhead in the printer;

identifying a cross-process displacement for each column of printheads; and identifying a stitch displacement in the cross-process direction between neighboring printheads in a print bar unit that print a same color of ink by:

computing a mean cross-process position for each leftmost inkjet ejector in a first printhead;

computing a mean cross-process position for each rightmost inkjet ejector in a second printhead that is a next nearest printhead left of the first printhead in the cross-process direction;

measuring a difference between the two mean cross-process positions; and identifying the stitch displacement by computing a difference between the measured difference between the two mean cross-process positions and an expected spacing between the two mean cross-process positions; and operating an actuator to move at least some of the printheads in the printer with reference to the identified process direction positions, identified cross-process displacements for each column of printheads, and the identified stitch displacements.

* * * * *